US006641221B1

(12) United States Patent
Kastlunger

(10) Patent No.: US 6,641,221 B1
(45) Date of Patent: Nov. 4, 2003

(54) CHILD'S SAFETY SEAT PILLOW

(76) Inventor: Maribel Kastlunger, 2266 Binday Way, San Diego, CA (US) 92054

( * ) Notice: Subject to any disclaimer, the term of this patent is extended or adjusted under 35 U.S.C. 154(b) by 0 days.

(21) Appl. No.: 10/223,772

(22) Filed: Aug. 20, 2002

(51) Int. Cl.[7] ..... A47G 9/00; A47C 7/38

(52) U.S. Cl. ..... 297/397; 5/636; 5/922; 297/392

(58) Field of Search ..... 5/636, 644, 655, 5/640, 922; 297/397, 393, 392

(56) References Cited

U.S. PATENT DOCUMENTS 3,285,658 A * 11/1966 Cleveland ..... 297/392
4,339,151 A * 7/1982 Riggs ..... 297/397
4,607,885 A * 8/1986 del Fierro ..... 297/397
4,617,691 A * 10/1986 Monti et al. ..... 5/436
5,378,042 A * 1/1995 Daneshvar ..... 297/393
5,519,906 A * 5/1996 Fanto-Chan ..... 5/636
6,219,865 B1 * 4/2001 Stokesbary ..... 5/640
6,457,195 B1 * 10/2002 Holste ..... 5/640
6,523,901 B2 * 2/2003 Smith ..... 297/392
2002/0067063 A1 * 6/2002 Taborro ..... 297/393

* cited by examiner

*Primary Examiner*—Alexander Grosz
(74) *Attorney, Agent, or Firm*—Steven W. Webb

(57) ABSTRACT

An improved head and neck support pillow is presented that is light-weight, washable, and can be attached to a standard child's safety seat. The pillow is designed to support a child's head and neck while the child is in the seat and the vehicle is in operation.

3 Claims, 3 Drawing Sheets

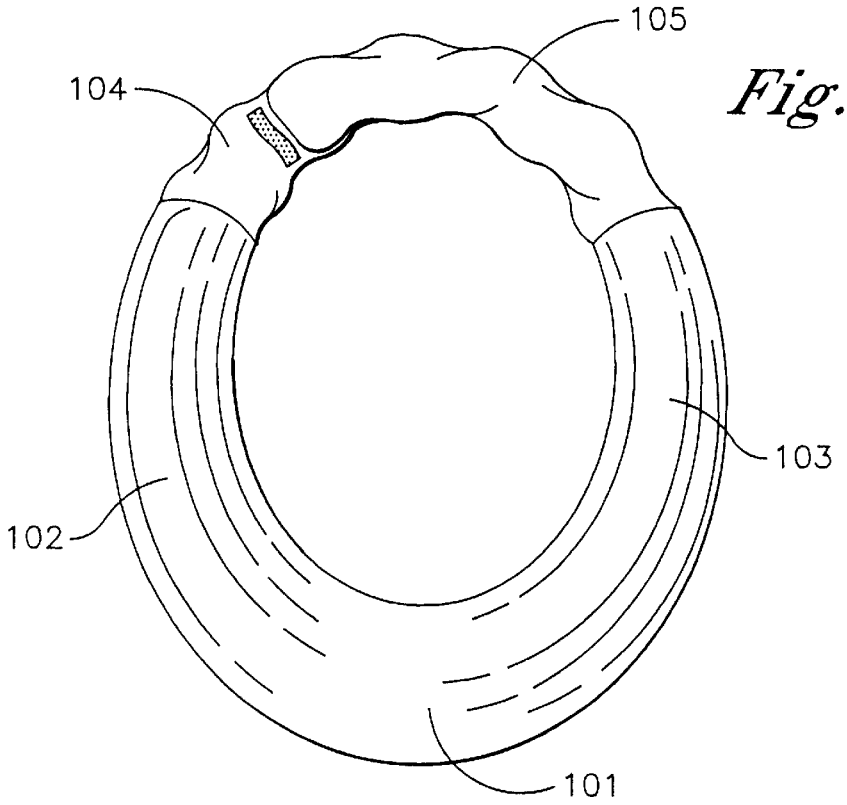
Fig. 3
Fig. 4
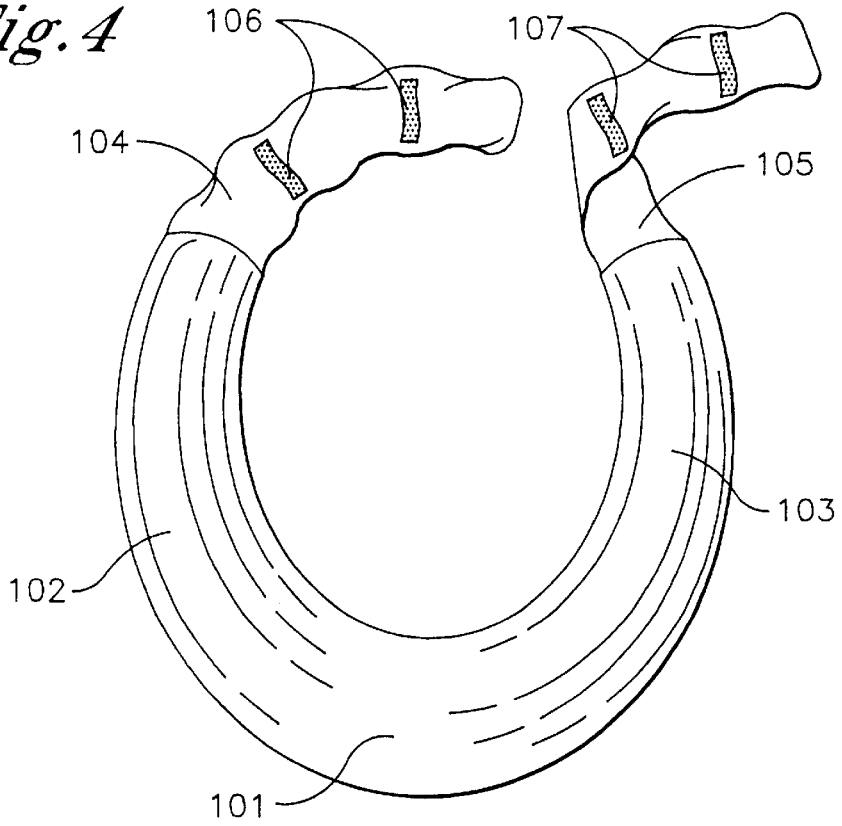

CHILD'S SAFETY SEAT PILLOW

FIELD OF THE INVENTION

This invention relates to headrests, headrest pillows, and head and neck support devices that can be attached to child safety seats, wheelchairs, and the like.

BACKGROUND OF THE INVENTION

Pillows, cushions, and other head supports/restraints are a common feature of seats and support systems such as wheelchairs and safety seats. This invention is particularly pointed towards child safety seats and the lack of support for children's heads in such seats.

Parents who place their children in such safety seats are often witnesses to a sleeping child's head falling forward or on one side while the child is in the seat. When sudden movement of the car occurs, such as a sharp turn or stop, or hitting a dip in the road, the child's head can move violently with unfortunate consequences. Children awaken suddenly and begin crying and can even suffer injury to the head or neck.

This invention addresses this problem by providing an easy-to-use, light-weight cushion that can be attached or used with a variety of seats and support systems. Travelers on trains or airplanes can also make use of this pillow to protect them from neck strain and eliminate snoring.

Similar inventions in the prior art include U.S. Pat. No. 4,617,691, awarded to Monti and Monti, which teaches a stand-alone wrap-around neck support that does not attach to a headrest, U.S. Pat. No. 4,738,488 awarded to Camelio, which teaches a complicated head support system for children in cars that does not prevent the child's head from slumping forward, and U.S. Application Publ. No. 2001/0037957, which shows a portable pillow system. None of these devices provides the head support for a child that the present invention possesses.

SUMMARY OF THE INVENTION

The present invention provides a light-weight, flexible support pillow that is shaped to be placed around the user's neck and attached via removable attachment means to a standard headrest or seat back.

It is an object of the present invention to provide an improved neck and head support pillow.

It is a further object of the present invention to make this pillow from flexibly soft materials and fillings that are durable and washable.

It is a further object of the present invention to make this pillow attachable to a variety of seat head rests and other neck and head support systems.

It is a further object of the present invention to make this pillow low-cost and easy to carry.

BRIEF DESCRIPTION OF THE DRAWINGS

The construction and operation of the invention can be readily appreciated from inspection of the drawings that accompany this application, combined with the detailed specification to follow.

FIG. 3 is a view of the invention showing the attachment means connected FIG. 4 is a view of the invention showing it with the attachment means disconnected

DETAILED DESCRIPTION OF THE INVENTION

Figure 1:
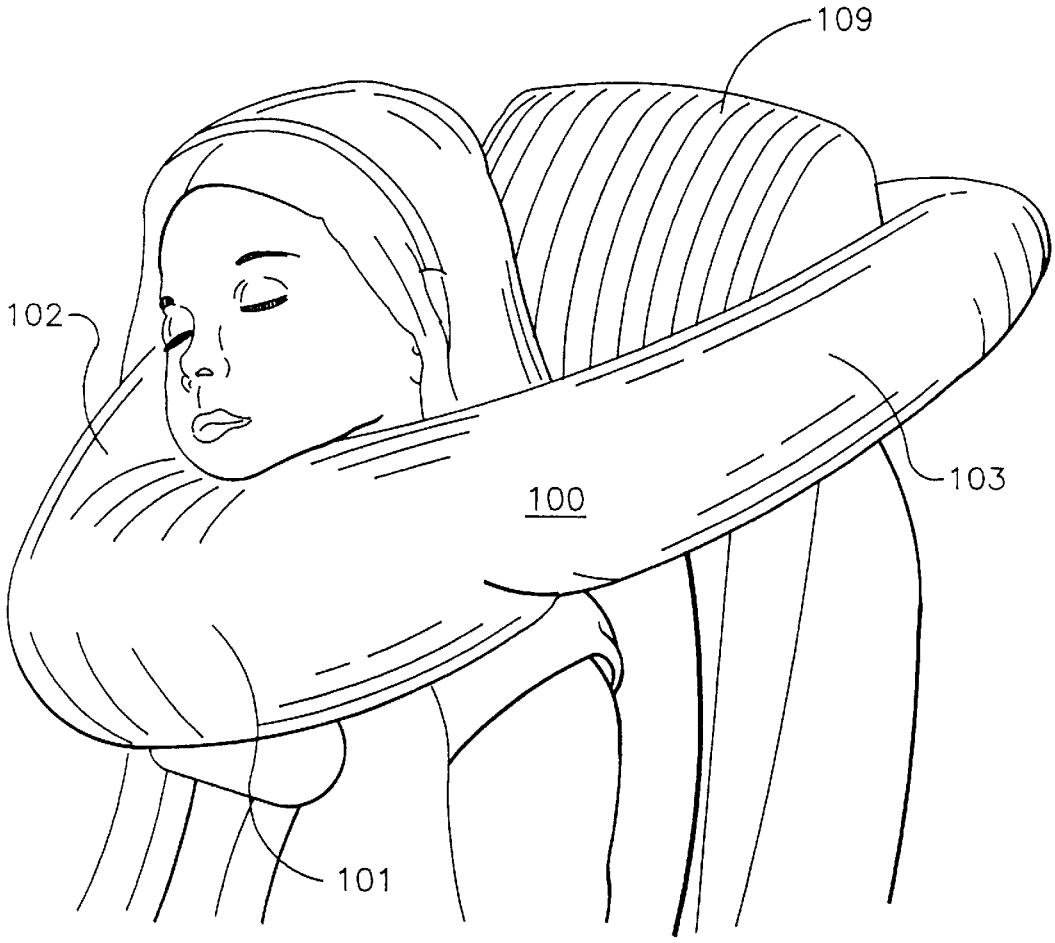
FIG. 1 is a view of the device in place on a standard car seat securely holding a child's head
Figure 2:
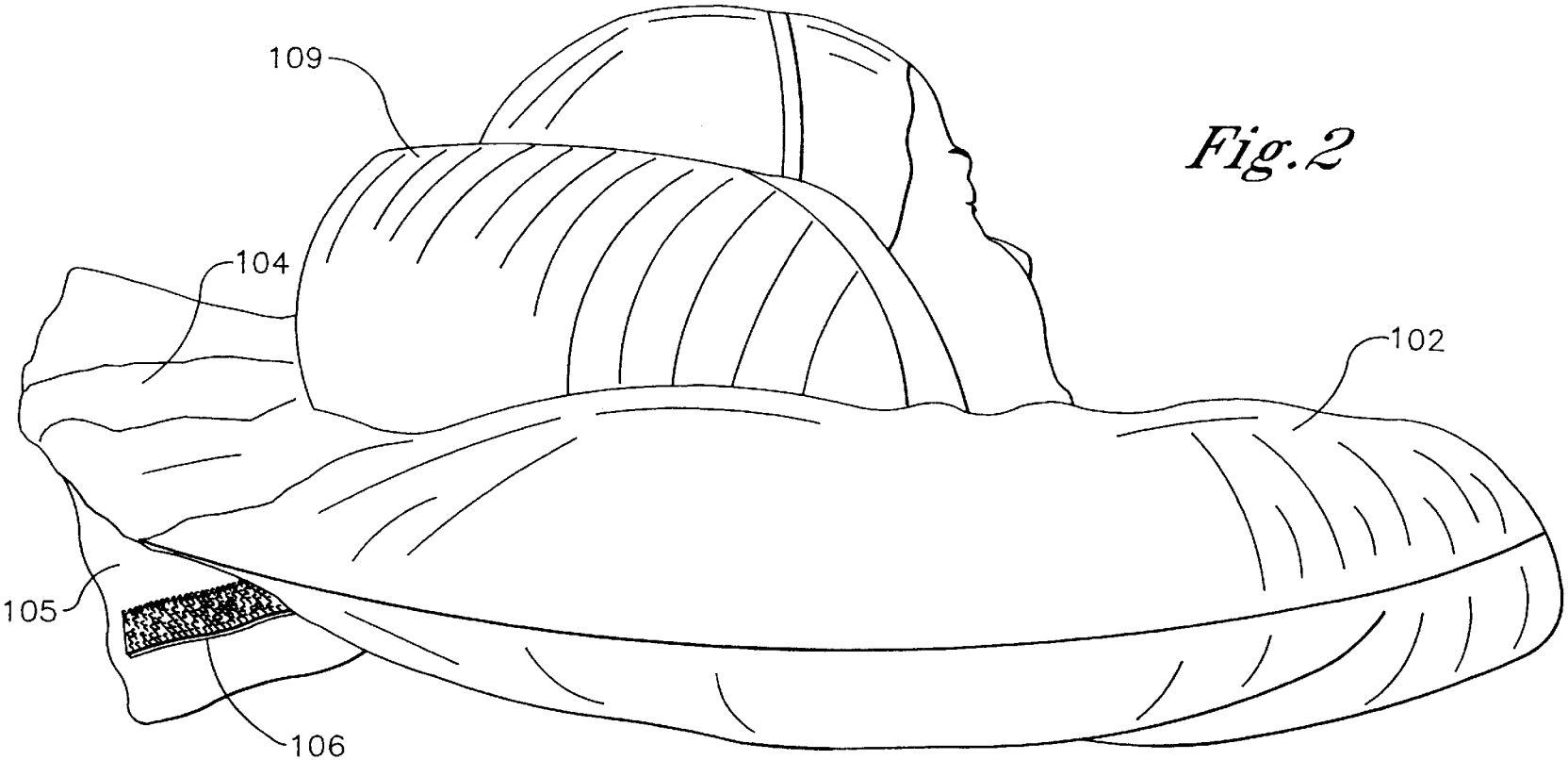
FIG. 2 is a back view of the invention on a standard car seat

In FIG. 1, the invention[100] is comprised of a head support part[101], a left neck support arm[102], a right neck support arm[103], and left and right attachment pads[104,105], which have two attachment means[106,107].

In the preferred embodiment, the attachment means[106,107] are hook and loop fasteners sewn onto the attachment pads[104,105] and the head support part[101] and left and right neck support arms[102,103] are fabric-covered pillow fill.

The left and right neck support arms[102,103] are long enough such that when the attachment pads[104,105] are brought into contact behind the head rest[108] of a standard car seat[109], the attachment means[106,107] can contact each other and the child's head is comfortably supported without choking danger.

In the preferred embodiment, there is a fabric cover for the head support part[101] and neck support arms[102,103] which is washable and absorbent, and the fill in the invention is pillow fill, which is also washable and absorbent. The invention is light-weight enough so that a child can easily carry it.

It is clear that the length of the neck support arms[102,103] can be extended so that the invention can be used to provide head support for seats with wider or taller headrests, such as airplane seats, without violating the spirit and intent of the invention.

Although the above is the preferred embodiment, other variations on this invention can be envisioned without departing from the spirit and intent of the inventor's idea.

What is claimed is:

1. A head and neck support pillow for child safety seats, said pillow comprised of a head support part, a left neck support part, a right neck support part, a left attachment pad and a right attachment pad, the child safety seat comprised of a head rest and seating area, the head support part merging smoothly into the left neck support part and the right neck support part, the pillow in the general shape of an open doughnut, the left attachment pad terminating the left neck support part, the right attachment pad terminating the right neck support part, the left attachment pad possessing a left attachment means and the right attachment pad possessing a right attachment means, the left attachment means and the right attachment means such that when they are brought into contact with each other, they form a removable connection strong enough to hold a child's head up by means of the pillow, the head and neck support pillow used by positioning a child in the safety seat seating area and then wrapping the head and neck support pillow around the child's neck under its chin in such a manner that the head support part supports the weight of the child's head, the left and right neck support parts lie alongside the child's head on either side, and the left and right attachment pads are removably connected to each other behind the safety seat head rest by means of the left and right attachment means.

2. The head and neck support pillow of claim 1, wherein the left and right attachment means are hook and loop type fasteners.

3. The head and neck support pillow of claim 1, wherein the head support part, the left and right neck support parts, and the left and right attachment pads are covered in washable fabric and are filled with pillow fill.

* * * * *